US005798026A

United States Patent [19]

Wacinski et al.

[11] Patent Number: 5,798,026

[45] Date of Patent: Aug. 25, 1998

[54] DRY END STEAM APPLICATOR

[75] Inventors: Witold Wacinski; Eugene Kolesniak, both of North Vancouver, Canada

[73] Assignee: Measurex Devron Inc., North Vancouver, Canada

[21] Appl. No.: 726,247

[22] Filed: Oct. 4, 1996

[51] Int. Cl.[6] ..... F26B 13/02; F26B 21/06

[52] U.S. Cl. ..... 162/290; 34/636; 34/638; 162/375; 162/281

[58] Field of Search ..... 162/290, 375, 162/281; 34/629, 636, 638

[56] References Cited

U.S. PATENT DOCUMENTS

| | | | |
|---|---|---|---|
| 3,945,570 | 3/1976 | Dove | 239/135 |
| 4,351,700 | 9/1982 | Dove | 162/290 |
| 5,020,469 | 6/1991 | Boissevain et al. | 162/207 |
| 5,149,401 | 9/1992 | Langevin et al. | 162/290 |
| 5,211,813 | 5/1993 | Sawley et al. | 162/207 |
| 5,355,595 | 10/1994 | Koivukunnas et al. | 34/638 |
| 5,623,771 | 4/1997 | Winheim | 34/633 |

OTHER PUBLICATIONS

Bouque "New Design Dry End Steam Showers Improve Sheet Quality, Runability" Pulp & Paper, May, 1989.

*Primary Examiner*—Karen M. Hastings
*Attorney, Agent, or Firm*—Christie, Parker & Hale, LLP

[57] ABSTRACT

A steam applicator to apply steam to a web passing by the applicator. The applicator is a main supply header and a plurality of profiling steam chambers to receive steam from the main supply header. The pre-heat chambers adjacent the profiling steam chambers. The flow of steam is controlled from the main supply header to each profiling steam chamber. At least one outlet in each profiling steam chamber allows a supply of steam from the applicator. The supply of steam from each outlet can be controlled. The apparatus is compact and has the virtue avoiding condensate dripper onto the web.

10 Claims, 6 Drawing Sheets

DRY END STEAM APPLICATOR

BACKGROUND OF THE INVENTION

This invention relates to a steam applicator.

DESCRIPTION OF THE PRIOR ART

Steam applicators or showers are much used in paper making machinery. They apply steam to a paper sheet passing beneath or above. The application of steam increases the temperature of the sheet to facilitate the removal of the water by decreasing the viscosity of the water and thus improving drainage of the water from the sheet. The shower is also used to improve and control the mixture and other sheet property profiles of the web by adding heat and water.

At the dry end of the sheet manufacturing a steam applicator is used to influence the gloss and the smoothness of the web. It is in this latter field that the present invention finds particular application.

The product available under the trademark Devronizer is an example of a steam shower normally used prior to the calendering of the paper. It is designed to operate on a paper or board machine to improve sheet or surface properties. Such a device is described in U.S. Pat. No. 3,945,570.

A problem with existing equipment operating at the temperature and pressure typical of steam applicators is the dripping of condensate onto the web. With an applicator positioned directly above the sheet the problem is difficult to overcome. The dripping of condensates on the sheet has an undesirable effect on the sheet. U.S. Pat. No. 5,211,813 owned by the applicant describes a product known under the trademark Calendizer that addresses this problem. A disadvantage with the Calendizer equipment is that it is not compact enough to fit into many calenders and super calenders. In general U.S. Pat. No. 5,211,813 overcomes the problem of dripping by the use of the heated zones around profiling steam sections. In this way the formation of condensate, and thus the dripping of condensate, is avoided.

SUMMARY OF THE INVENTION

The present invention provides a steam applicator that is compact and can be installed in a wide variety of locations.

Accordingly, in a first aspect, the present invention is a steam applicator to apply steam to a web passing by the applicator and comprising:

- a main supply header;
- a plurality of profiling steam chambers to receive steam from said main supply header;
- pre-heat chambers adjacent said profiling steam chambers;
- means to control flow of steam from said main supply header to each profiling steam chamber;
- at least one outlet in each profiling steam chamber to allow a supply of steam from the applicator; and
- means to control said supply of steam from each outlet.

BRIEF DESCRIPTION OF THE DRAWINGS

The invention is illustrated in the drawings in which.

DESCRIPTION OF THE PREFERRED EMBODIMENTS

Figure 1:
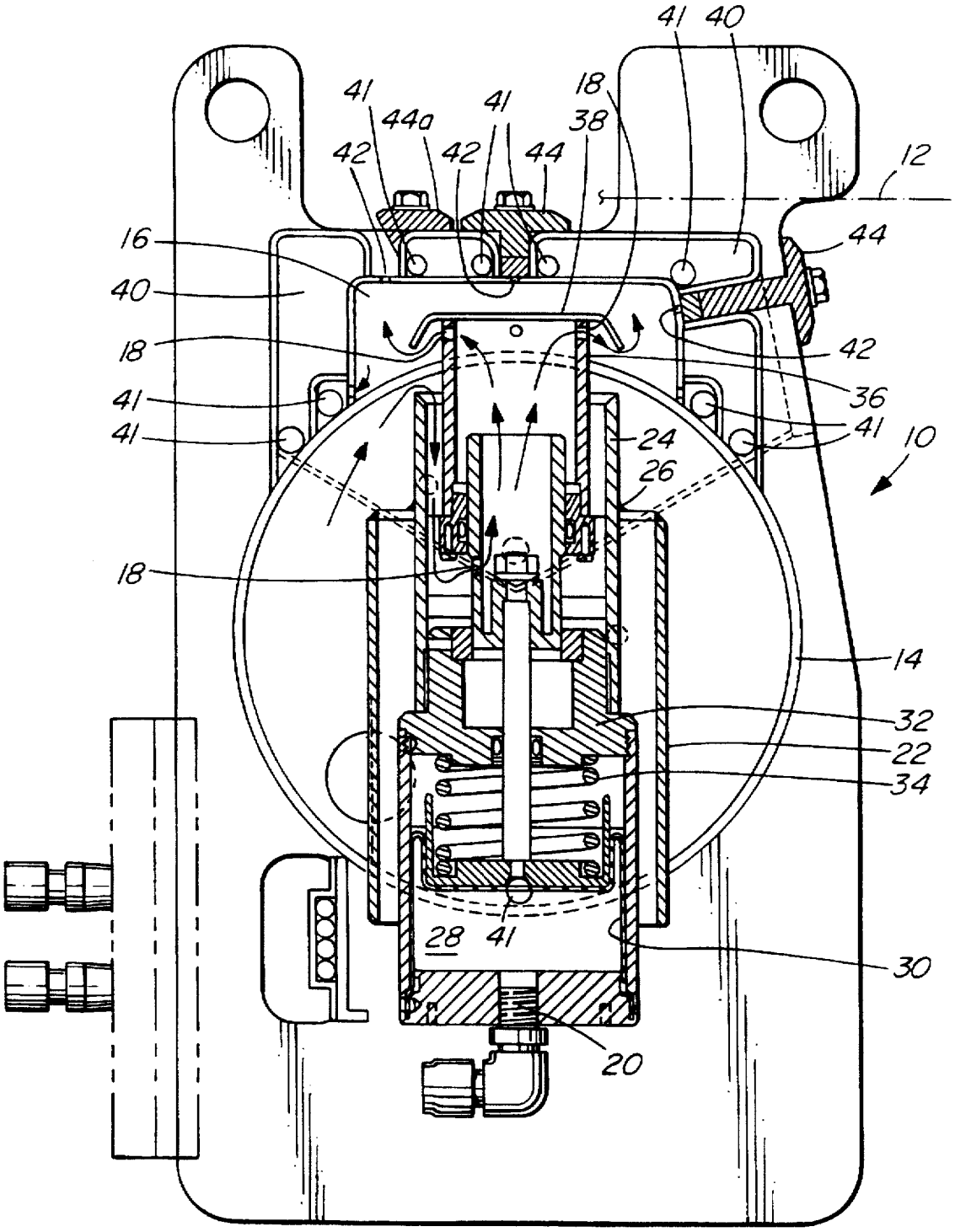
FIG. 1 is a section through a steam applicator according to the present invention.

The drawings show a steam applicator 10 to apply steam to a web 12. In the illustrated embodiment of FIG. 1 the web 12 passes above the steam applicator 10. The equipment of the present invention is equally appropriate for positioning above the web or in the pocket formed by the sheet and a fly roll.

The applicator 10 comprise a main supply header 14, common in the art to which steam is supplied, again by means common in the art. There is a plurality of profiling steam chambers 16 arranged on the outside of the main supply header 14 to receive steam from the main supply header 14. The steam path is shown by the arrows in FIG. 1. Appropriate openings 18 are provided as discussed below.

There are means to control the flow of steam from the main supply header 14 to each profiling steam chamber 16. In the illustrated embodiment the means comprise a plug valve that is pneumatically controlled through inlet/outlet 20. The plug valve comprise a housing 22 that receives a tubular body 24, welded at 26. There is an air chamber 28 and a diaphragm 30 abuts the base of a valve member 32. The valve member 32 is loaded by spring 34 to return to the rest position when pressure is released. At its upper end the valve comprises a tube 36 having openings 18, the arrangement being such that steam can pass from the main supply header 14, along a convoluted pathway down the outside of tube 36, into openings 18 in the valve member 32 and upwardly inside the tube 36. The tube 36 is capped at 38 and openings 18 in the periphery permit the steam to pass outwardly into a profiling steam chamber 16.

The converse of the above arrangement can be used. That is a spring may be used to urge the valve member 32 from its rest position and pneumatic pressure used to return the valve 32 to the rest position.

Flow through the valve is controlled by the application of air pressure which moves the valve upwardly or downwardly relative to tubes 22 and 24 and thus restricts or opens the openings 18 to allow the passage of steam.

The skilled worker will appreciate that any means of operating the valve is appropriate. For example, an electrical operating valve may be used. Hydraulic pressure may also be used in place of the illustrated pneumatic pressure.

There are pre-heat chambers 40 adjacent the profiling steam chambers 16 that receive steam at a relatively high pressure, for example about 14 psi. In general steam is supplied to the applicator in the present invention at about 15 psi. The steam supply is divided so that steam to the main steam header is typically at 1–10 psi and steam to the heating zones is typically unrestricted in pressure and remains at about 14 to 15 psi. This may be done by a known use of valves in the supply of steam to the applicator.

From the profiling chambers 16 steam leaves through outlets 42 that are arranged to allow steam to pass in a plurality of directions. Although a plurality of outlets is shown one may be sufficient.

There are means to control the supply of steam from each outlet 42. In the illustrated embodiment plugs 44 are shown. These plugs 44 may be attached to block off an outlet 42 or, as shown in plug **44*a* in FIG. 1, partially block off the opening. Furthermore FIG. 2** shows the use of the plugs as partial plugs that are used to direct the steam relative to the paper sheet direction.

The supplying of steam to profiling steam chambers is known in the art. Each valve is independently controlled and information concerning the cross-directional properties of the web, for example gloss, smoothness, caliper and the like of the web 12 is sent upstream. Depending on the results the valves can be opened or closed in a cross-machine direction to ensure that more or less steam is applied to the web 12 at local areas.

Figure 3:
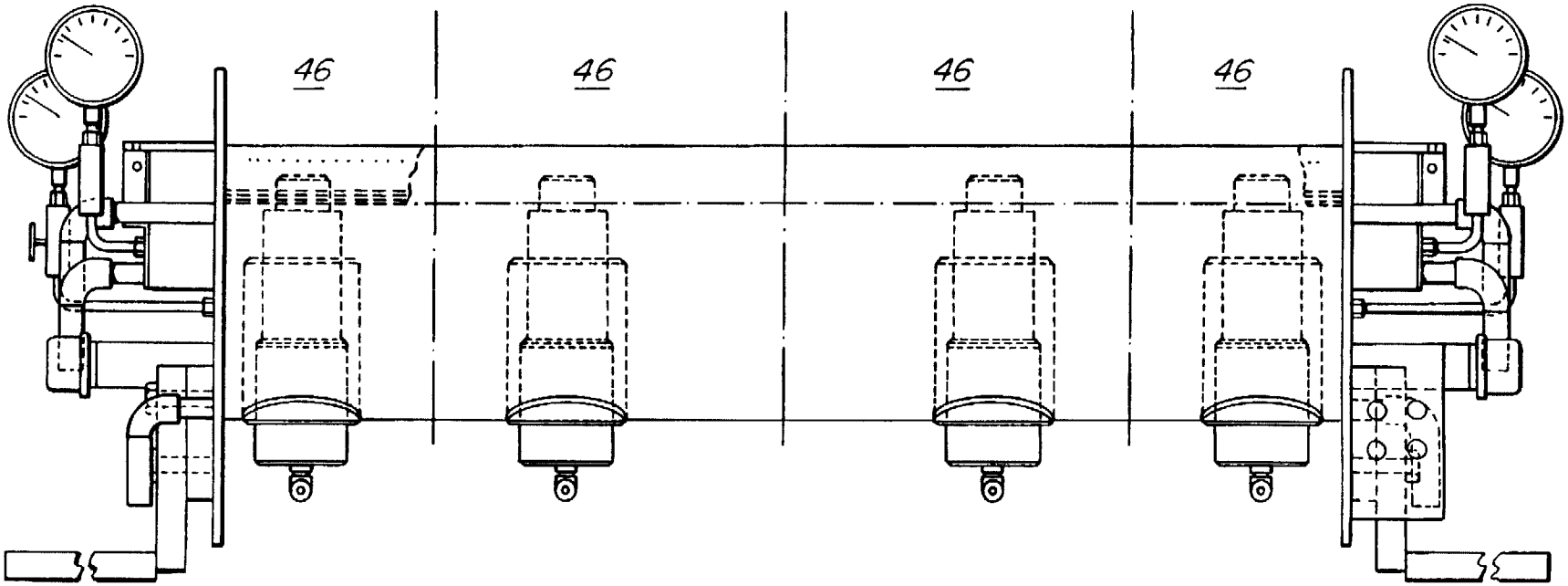
FIG. 3 is a general view illustrating the profiling steam chambers.

The profiling steam chambers 40 are formed by internal baffles to define zones 46 as shown in FIG. 3.

The outlets 42 in the profile chambers 16 direct steam in jets in two directions, the directions being generally perpendicular to each other in the illustrated embodiment although this is not essential.

Figure 4:
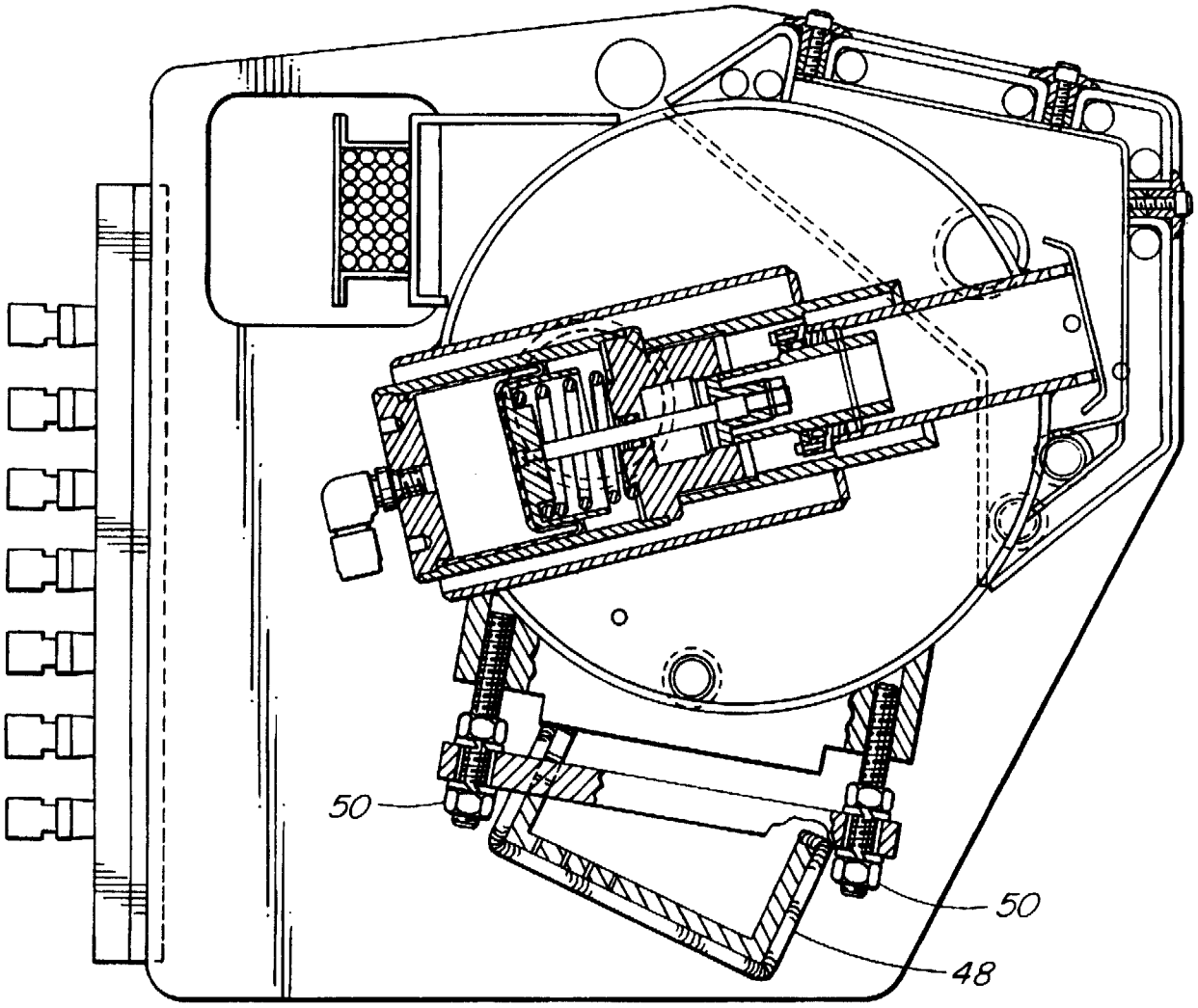
FIG. 4 is a further embodiment of the invention of FIG. 1 that closely resembles FIG. 1.

In the illustrated embodiment of FIG. 4 there is holder 48 for a doctor blade mounted on an external surface of the steam applicator. The doctor blade holder 48, includes levelling screws 50 to make the mounted channel conform to a desired mechanical alignment.

Figure 5:
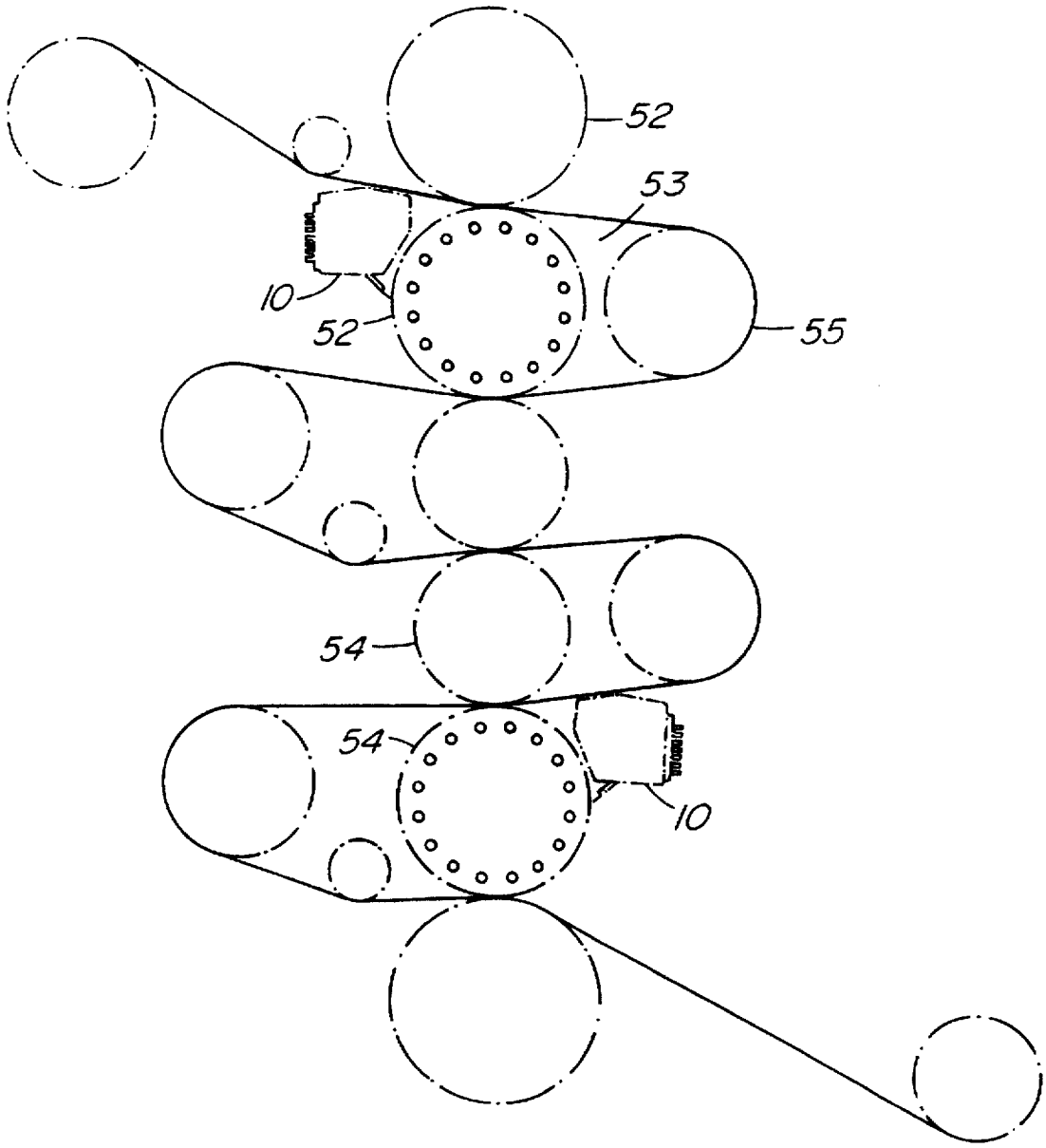
FIGS. 5, 6 and 7 illustrate locations of a steam applicator according to the present invention on a typical super calender or soft nip calender.
Figure 6:
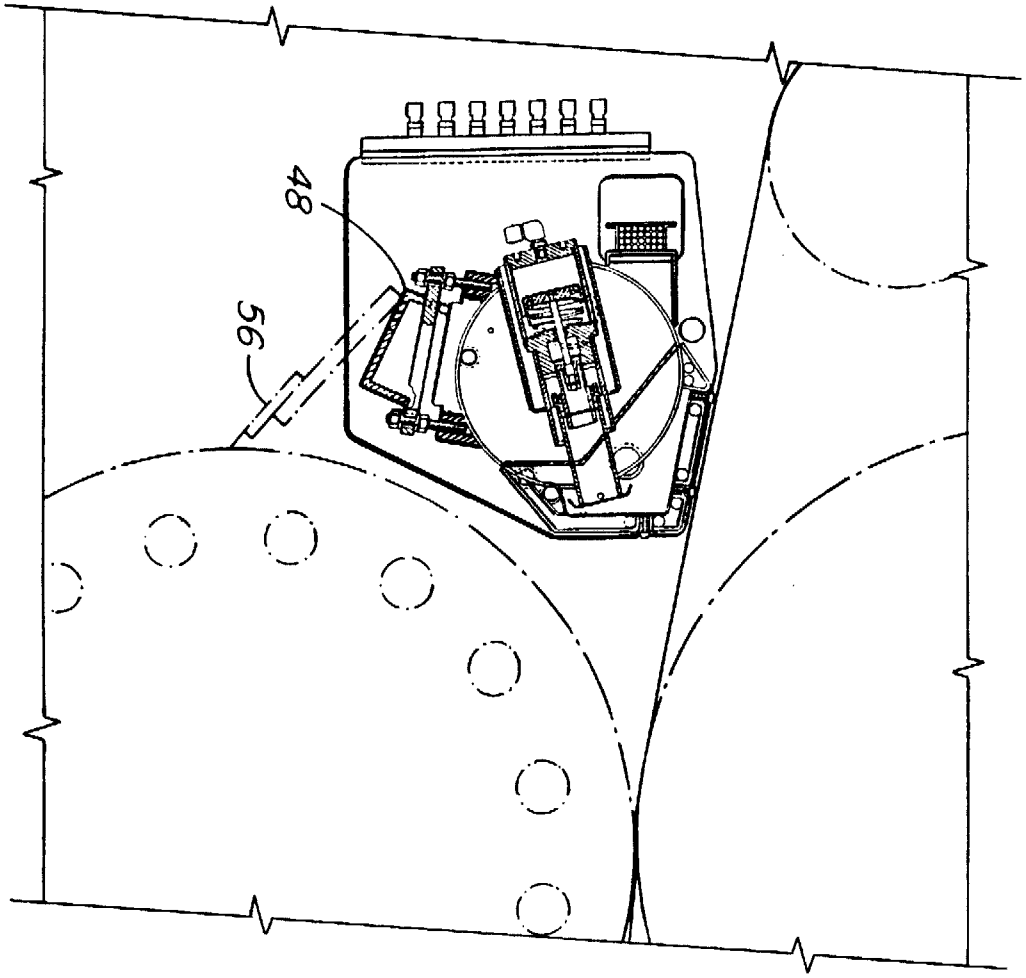
Figure 7:
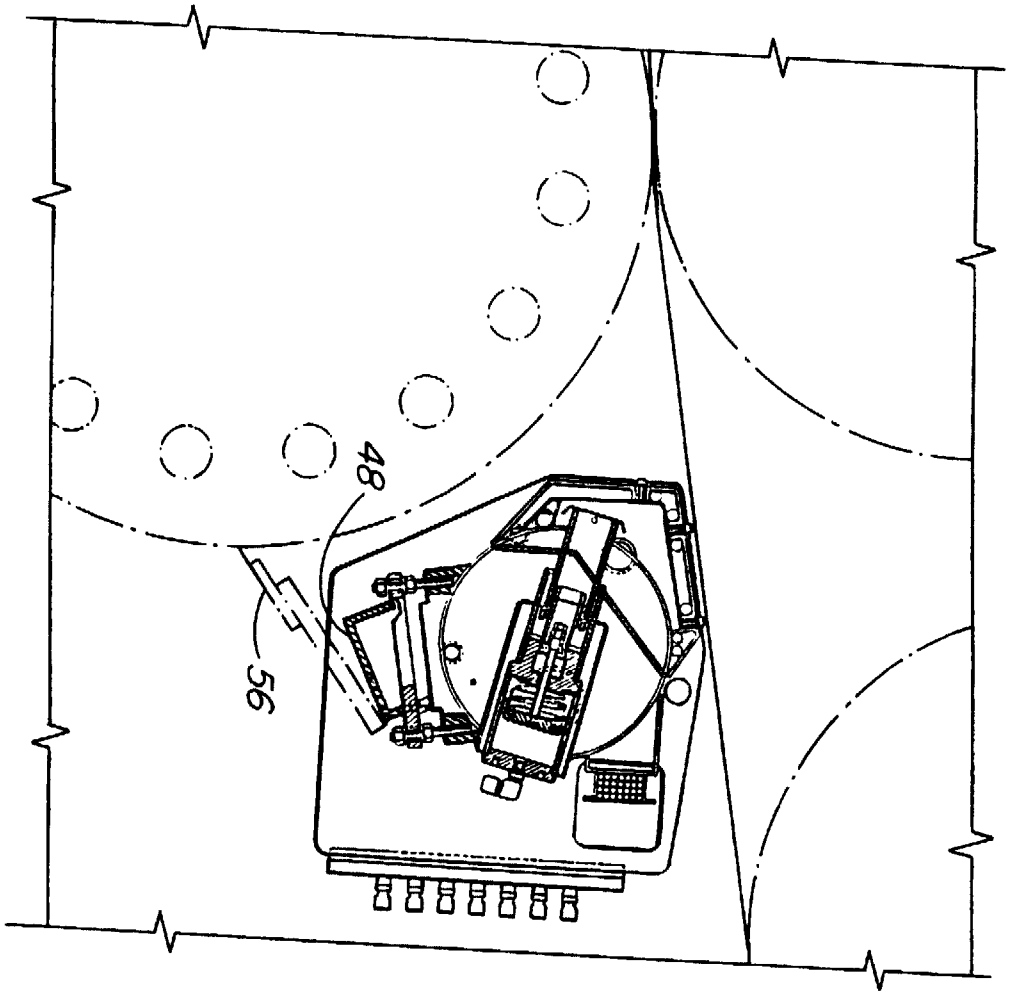

FIGS. 5, 6 and 7 are included to illustrate a typical location of apparatus 10 according to the present invention in the paper making process. FIG. 5 shows a pair of steam applicators mounted in the nip of rolls 52 and 54. Steam may be directed into the sheet or into the nip, or both, according to process requirements. As well, steam applicator 10 can be installed in pocket 53 formed by the sheet and fly roll 55. FIGS. 6 and 7 illustrate on a larger scale, the arrangement of FIG. 7. A doctor knife 56 is shown in position mounted on the doctor knife holder 48 to contact a roll.

The apparatus of the present invention receives high pressure steam for pre-heating. The higher pressure steam is at a higher pressure and hence temperature of the profiling steam. This serves two important requirements. First the high temperature of the outside of the unit prevents condensation from forming on the outer surfaces and falling from there onto the web.

Secondly the higher temperature steam surrounds the profiling steam passages thus heating up any condensate or entrained water that might be present with the profiling steam. By causing the evaporation of this water (if present) the apparatus of the present invention ensures that no water spits onto the web. Furthermore the steam path from the main supply header to the profiling screen that is the outer surface of the profiling steam chambers containing the outlet goes through a number of pressure drops to ensure uniform distribution of steam and the separation of entrained water or condensate from the steam. As shown particularly in FIG. 1 there are two pressure drops through the valve, one pressure drop on the valve outlet and a final pressure drop across the screen plate, that is at the outlets from the profiling steam chambers. The above pressure drops entails sudden changes in steam direction.

Figure 2:
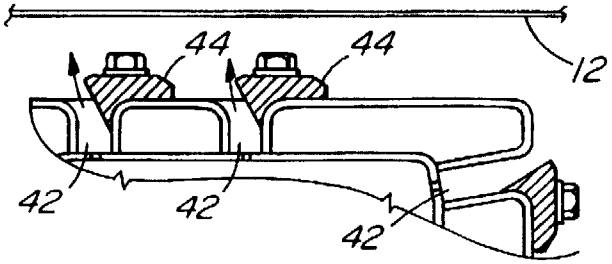
FIG. 2 is a detail of the applicator of FIG. 1.

The sudden change in steam direction cause a separation of any water drops from the steam; this water is bled out of the system utilizing a plurality of condensate drains 41, best shown in FIG. 1.

Thus the present invention provides a compact apparatus, able to fit where prior art apparatus has not been able to fit yet with the advantages of avoiding drip onto the web.

We claim:

1. A steam applicator to apply steam to a web passing by the applicator and comprising:

a main supply header;

a plurality of profiling steam chambers to receive steam from said main supply header;

pre-heat chambers adjacent said profiling steam chambers;

means to control flow of steam from said main supply header to each profiling steam chamber;

at least one outlet in each of the profiling steam chambers to allow a supply of steam from the applicator; and means to control said supply of steam from each outlet comprising a plug to fit into each outlet.

2. A Steam applicator as claimed in claim 1 in which steam supplied to the main supply header in each of the said profiling chambers is controlled so that steam to the heating zone is at about the same pressure as steam supply and steam to the main supply header is in the range of 1–10 psi.

3. A steam applicator as claimed in claim 2 in which the steam passes along a convoluted path to assist in pressure drop and to remove condensate.

4. A steam applicator as claimed in claim 1 in which the profiling steam chambers are formed by baffles arranged on the exterior of the main supply header.

5. A steam applicator as claimed in claim 1 in which the means to control flow of steam comprise a plug valve between the main supply header and each profiling steam chamber.

6. A steam applicator as claimed in claim 1 in which the outlets in each of the profile steam chambers direct steam in jets in two directions perpendicular to each other.

7. A steam applicator as claimed in claim 1 in which each plug partially blocks each opening.

8. A steam applicator as claimed in claim 7 in which the plug has inclined edges to direct steam.

9. A steam applicator as claimed in claim 1 that includes a holder for a doctor blade mounted on an external surface.

10. A steam applicator as claimed in claim 1 including condensate drains in the header and each of the chambers to remove build-up of condensate.

* * * * *